US006314595B1

(12) United States Patent
Price

(10) Patent No.: US 6,314,595 B1
(45) Date of Patent: Nov. 13, 2001

(54) INTERLOCKING BED FRAME WITH INTEGRATED LADDER AND SAFETY RAIL SYSTEMS

(75) Inventor: Joel F. Price, Chevy Chase, MD (US)

(73) Assignee: Joel Price, Chevy Chase, MD (US)

( * ) Notice: Subject to any disclaimer, the term of this patent is extended or adjusted under 35 U.S.C. 154(b) by 0 days.

(21) Appl. No.: 09/521,889

(22) Filed: Mar. 9, 2000

(51) Int. Cl.[7] ..... A47C 19/00
(52) U.S. Cl. ..... 5/201; 5/9.1; 5/11
(58) Field of Search ..... 5/9.1, 8, 11, 611, 5/201, 186, 189; 256/65

(56) References Cited

U.S. PATENT DOCUMENTS

| | | | |
|---|---|---|---|
| D. 250,499 | | 12/1978 | O'Gwin, Jr. et al. . |
| D. 279,735 | | 7/1985 | Anacker . |
| D. 282,029 | | 1/1986 | Ells . |
| D. 294,893 | | 3/1988 | Mowery et al. . |
| D. 309,422 | | 7/1990 | Zitting . |
| D. 333,048 | | 2/1993 | deBlois . |
| D. 346,076 | | 4/1994 | Brunel . |
| D. 349,199 | | 8/1994 | Woodhams . |
| D. 366,970 | | 2/1996 | Pollard . |
| D. 379,877 | | 6/1997 | Tilley . |
| D. 381,830 | | 8/1997 | Fisher . |
| 610,078 | | 8/1898 | Newman . |
| 895,898 | | 8/1908 | Scheer . |
| 2,230,889 | | 2/1941 | McArthur . |
| 2,647,267 | | 8/1953 | McLaughlin . |
| 3,638,814 | | 2/1972 | Lowery . |
| 3,886,604 | | 6/1975 | Ewing . |
| 4,483,027 | | 11/1984 | Cowell et al. . |
| 4,896,385 | | 1/1990 | Bustos . |
| 4,940,149 | * | 7/1990 | Vineis ..... 211/186 |
| 5,003,650 | | 4/1991 | Caya . |
| 5,233,707 | | 8/1993 | Perkins . |
| 5,500,963 | | 3/1996 | Yeh . |
| 5,517,744 | | 5/1996 | Moser et al. . |
| 5,655,234 | * | 8/1997 | Randleas ..... 5/9.1 |
| 5,829,074 | | 11/1998 | Fisher . |
| 5,832,548 | | 11/1998 | Moser et al. . |

* cited by examiner

*Primary Examiner*—Lynne H. Browne
*Assistant Examiner*—Fredrick Conley
(74) *Attorney, Agent, or Firm*—McGuireWoods LLP

(57) ABSTRACT

A bunk bed or a high rise (loft) bed framing system. The framing system incorporates interlocking tubular rails and posts for constructing the framing system. The tubular rails and posts are of varying diameters which fit into corner posts. The tubular rails and posts form an integrated ladder system and an integrated safety rail system when the framing system is assembled. The ladder system and the safety rail system provide added safety to the user while providing further stability, stiffness and durability to the framing system.

16 Claims, 8 Drawing Sheets

RTA (READY-TO-ASSEMBLE) BEDS
SHIPPING WEIGHTS AND SIZES

| BED TYPE | # OF BOXES | APPROX. WEIGHT |
|---|---|---|
| LOFT | 2(*1) | 160 LBS |
| BUNK | 2(*1) | 186 LBS |

* NOTE: EITHER BED CAN BE PACKAGED IN JUST ONE 12"x12"x90" BOX FOR MORE COMPACT SHIPPING WHEN UTILIZING COMMON FREIGHT CARRIER

INTERLOCKING BED FRAME WITH INTEGRATED LADDER AND SAFETY RAIL SYSTEMS

BACKGROUND OF THE INVENTION

1. Field of the Invention

The present invention generally relates to an interlocking bed frame and, more particularly, to a bed frame assembly having interlocking ladder rungs and safety rails for added stability and safety.

2. Background Description

Conventional beds are typically manufactured from stainless steel or other metal constructions. It is also common for beds to be manufactured from wood or other laminate products.

In order to assemble beds made from stainless steel, the posts of the frame are either welded or fastened to one another using fastening bolts. In the case of wood frame beds, wood screws, wood glue and other conventional wood fasteners are used to fasten the posts and rails of the frame to one another. In either instance, many problems may arise due to poor construction ranging from the failure of the welds or fasteners over an extended period of use to a host of other safety issues. These safety issues are of the utmost importance, especially for children's beds and in particular for bunk beds and high rise (loft) beds.

With regard to the safety of the user, the Consumer Product Safety Commission (CPSC) has extensively studied accidents associated with bunk beds. These accidents range from failure of the framing system of the bunk bed to falls from the top of the bunk bed to the improper use and design of ladders and the like.

In order to address many of these problems, the CPSC has promulgated minimum voluntary requirements for the design and performance of bunk beds. These safety requirements are intended to minimize accidents by the user and especially children during the use of the bunk beds. These requirements address issues such as, for example, 1. Minimum height of lift between the bedposts of the top bunk and the bottom bunk to ensure the prevention of disengagement of the bedposts.
2. Mattress and frame size and fit, as well as the method of assembly of the frame support system.
3. The construction and assembly of side rails, guard rails as well as cross members positioned under the mattress.
4. The design, construction and use of ladders in conjunction with bunk beds.

Despite the CPSC voluntary requirements, many bunk beds (and high rise beds) still do not meet these requirements. By way of example, it is not uncommon for the frame welding or fastening bolts to fail without any notice to the user. In these instances, the bunk bed may collapse without warning to the user thus causing serious injury to the user. This is of special concern when the user is sleeping at the time of the weld or fastening bolt failure.

It is also known that many ladder designs slip away from the bunk bed when the user is climbing the ladder. These same ladders may also not be of the most sturdiest construction, and over extended use may become weakened and unstable. In both instances, the user is at risk from falling from the ladder and potentially injuring themselves.

Also, once on the top of the bunk bed or high rise bed, it is not uncommon for children to fall from the bed. This may be due to either the lack of a safety rails or the inadequate construction of the safety rails. In the latter case, the safety rails may not be designed to withstand the weight of the user. In either case, this can be potentially very dangerous to the user in view of the height of the top bunk or high rise bed.

What is thus needed is a bunk bed or high rise bed (collectively referred to hereinafter as a bunk bed) assembly that provides added stability as well as added safety to the user. The bunk bed should be of durable construction and should not include welds or fastening bolts that may fail over an extended use. The bunk bed should include an integrated ladder that would not slip away from the bunk bed, while providing a sturdy and long lasting construction. The bunk bed should also include safety rails so that a child or other users will not fall from the bed during use thereof. The bunk bed should also be easy to assemble and disassemble while still providing a sturdy construction even after the user has disassembled and reassembled the bunk bed numerous times.

SUMMARY OF THE INVENTION

It is thus an object of the present invention to provide a framing system that does not use bolts or welds to fasten the frame members to one another.

It is a further object of the present invention to provide a framing system that includes an integrated ladder system that will be able to withstand extended use and which will not slip away from the framing system during use thereof.

It is also an object of the present invention to provide a framing system that includes an integrated safety rail system which will be able to prevent a user from falling from a bed.

It is an additional object of the present invention to provide a framing system that is capable of being disassembled and reassembled numerous times without affecting the integrity of the framing system.

It is still a further object of the present invention to provide a framing system that is easy to assemble and disassemble.

It is still an additional object of the present invention to provide a framing system that provides added stiffness and stability to the framing system.

It is additionally an object of the present invention to provide a framing system that is capable of being compactly packaged.

According to the invention, there is provided a framing system having an interlocking system which provides for easy assembly and disassembly and further provides added stability to the entire framing construction of the present invention. The framing system includes corner posts each having a hollow center section along the longitudinal axis and a variety of sized holes. The holes are designed to accommodate frame members which form the bed frame. The holes are positioned at varying heights on each corner post, and are specifically designed so that some holes are positioned away from other holes by substantially 90 degrees. The corner posts should be a larger diameter than the remaining frame members.

Side rail supports are positioned between the corner posts in preferably a length-wise direction. The side rail supports each have opposing end holes which, in the assembled arrangement, are fully positioned within the hollow center section of each corner post. The side rail supports also include additional holes which accommodate vertical guide rail supports and horizontal bed foundation supports. The vertical guide rail supports extend to upper horizontal side rails, which each extend in a length direction between opposing corner posts. The horizontal side rails also include opposing end holes which, in the assembled arrangement, are fully inserted into the hollow center section of each corner post and form a portion of the guard rail.

Intermediate guard rails may extend through holes of the vertical guide rail supports, and extend between the corner posts. The intermediate guard rails extend into the hollow center section of each corner post up to and against the dowel. The intermediate guard rails in combination with the upper horizontal side rails form an integrated safety rail (or guard rail) on the sides of the bed so that children or other users will not fall from the top bed. Safety rails may also formed at the ends of the bed by the ladder rungs.

Ladder rungs extend between opposing corner posts. The ladder rungs provide an integrated ladder system when the frame of the present invention is assembled, and additionally provide support and stability to the framing system. The ladder rungs each include opposing end holes which extend into the holes of the corner posts. In the assembled construction, the opposing end holes of the ladder rungs are substantially aligned with (i) the longitudinal axis "Y" of each corner post, (ii) the opposing end holes of the side rail supports, (iii) the opposing end holes of the horizontal side rails and (iv) the opposing end holes of the rails.

In order to properly assemble the bed frame of the present invention, dowels extend through transverse openings and into the hollow center section of the corner posts. The dowels are also placed through the opposing end holes of the (i) the side rail supports, (ii) the horizontal side rails, (iii) the ladder rungs and (iv) the rails. The dowels may include a tapered edge for easier insertion into the respective opposing end holes. In this manner, the ladder system and the safety rail system are interlocked to the entire framing system, and cannot be disassembled unless the dowels are removed from each corner post.

In order to pack the framing system, the smaller diameter frame members (e.g., horizontal bed foundation supports) fit within or are concentrically disposed within the larger diameter frame members (e.g., side rail support). The dowels may be placed within the hollow section of most any of the frame members. In this manner, the frame members may be compactly packaged together. This packaging will work equally well with frame members of any cross sections such as square, triangular, polygonal and the like.

By using the framing system of the present invention, the ladder system and the safety rail system are integral parts of the framing system of the present invention. There is thus no need to use bolts, welds or other fasteners which may fail over an extended use. Also, by using the construction of the present invention, sharp edges, weld failures and other shortcomings of the prior art systems are avoided.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

The present invention is directed to a bunk bed and a high rise (loft) bed framing system, and may be adapted for traditional single, twin, extra long twin, full, double, queen and king beds. The framing systems of the present invention are preferably constructed of polyvinylchloride (PVC) hollow tubing and include safety features such as, for example, an integrated ladder system and safety rail system. The framing systems are preferably designed for children's use in a residential setting, but may equally be used for adults in both residential or institutional settings. The construction of the present invention includes interlocking tubular rails and posts which enables the ladder system and safety rail system to be integrated with the entire bed frame. This interlocking system also provides for easy assembly and disassembly and further provides added stability to the entire framing construction of the present invention.

It should be well understood by one of ordinary skill in the art that the present invention may be made of any material which is capable of providing an interlocking system of sturdy construction such as, for example, stainless steel and the like. It should further be understood that the framing systems of the present invention can be of different dimensions to accommodate adults, children and even young toddlers, and therefore the specific dimensions of the present invention, including length, width, shape and other variables specified herein may vary with the type and size of bed being used with the system contemplated herein. Therefore, numbers and dimensions specified herein are not to be construed as limitations on the scope of the present invention, but are meant to be merely illustrative of one particular application of the present invention.

Figure 1:
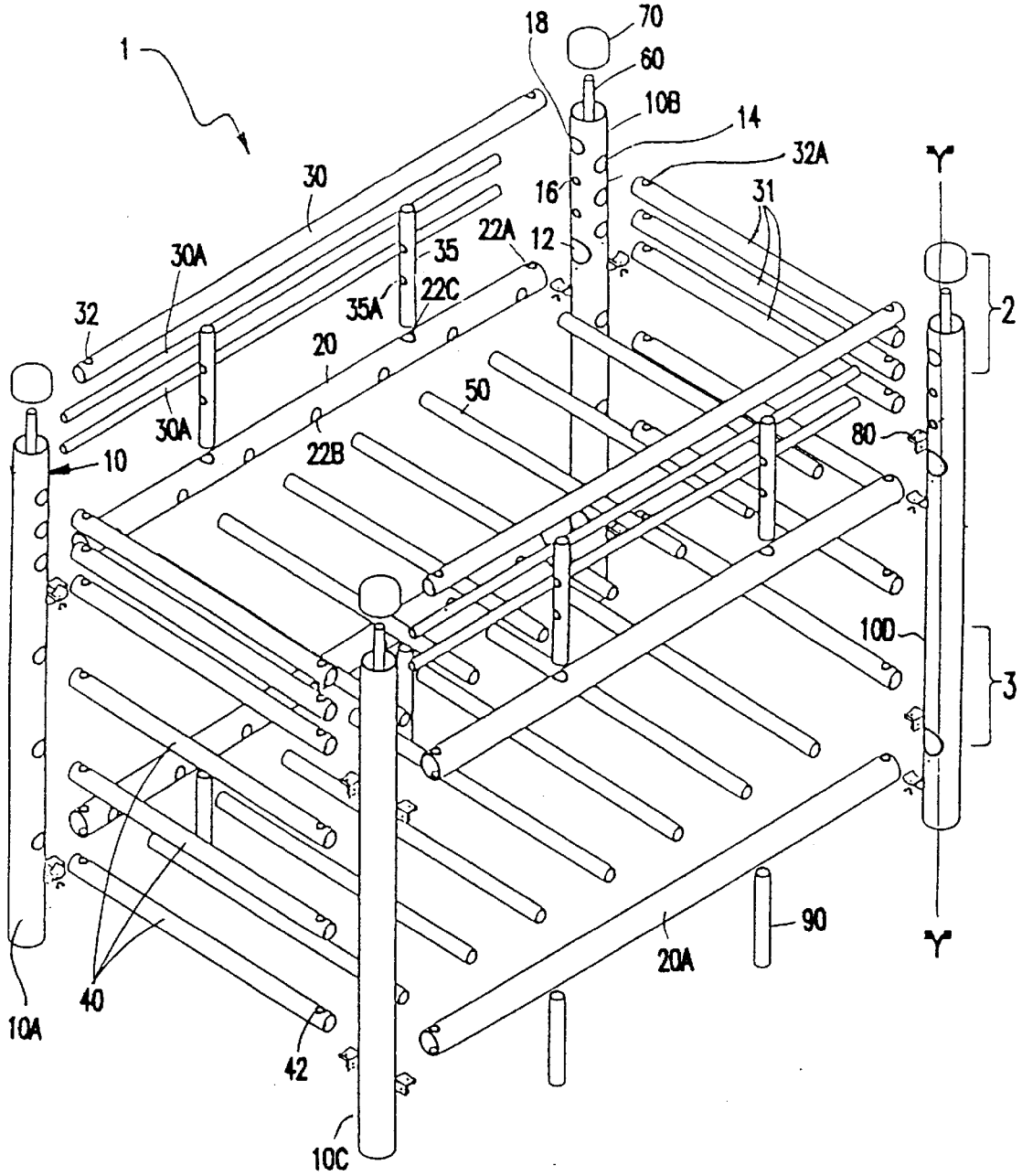
FIG. 1 is a perspective view of a bed in an unassembled form according to a first embodiment of the present invention.

Referring now to the drawings, and more particularly to FIG. 1, a perspective view of a bed 1 in an unassembled form is shown according to a first embodiment of the present invention. Specifically, the bed 1 of FIG. 1 depicts a bunk bed having an upper bedding frame system 2 and a lower bedding frame system 3 with common corner posts generally depicted as 10. The framing system is preferably constructed of standard size schedule 40 rigid PVC tubing having a high gloss, impact resistant Ultra Violet (UV) protected furniture grade finish; however, other machined components can equally be used for the framing system of the present invention. The diameter of each frame member (e.g., rails and posts) preferably ranges from 1 inch to 4 inches in diameter, but may vary depending on the particular application used with the framing system of the present invention such as, for example, dormitory use or other institutional uses. The different diameter rails and posts allow the frame members to be telescopically inserted into one another for easy and compact packaging, shipping and handling.

Still referring to FIG. 1, the framing system of the present invention includes four corner posts 10*a*, 10*b*, 10*c* and 10*d*. Each of the corner posts 10*a*, 10*b*, 10*c* and 10*d* have a hollow center section along the longitudinal axis and a variety of sized holes 12, 14, 16 and 18. The holes 12, 14, 16 and 18 are designed to accommodate frame members which form the bed frame. The holes 12, 14, 16 and 18 preferably vary in size from larger diameter holes which accommodate structural frame members such as ladder rungs and side rail supports to smaller diameter holes for accommodating railings. The holes may also be the same size. In the preferred embodiment, the holes 14 and 18 have preferably a same diameter and shape.

The holes 12, 14, 16 and 18 are positioned at varying heights on each corner post 10*a*, 10*b*, 10*c* and 10*d*, and are specifically designed so that the holes 12, 16 and 18 are positioned away from the holes 14 on each corner post 10*a*, 10*b*, 10*c* and 10*d* by substantially 90 degrees. In conjunction with the 90 degree spacing, the holes 14 should preferably not be at the same height as any of the holes 12, 16 and 18 on each of the corner posts 10*a*, 10*b*, 10*c* and 10*d* so that the frame members can be assembled in a substantially rectangular structure in accordance with the system of the present invention. In the preferred embodiment, the corner posts 10*a*, 10*b*, 10*c* and 10*d* are of a larger diameter than the remaining frame members, and each corner post 10*a*, 10*b*, 10*c* and 10*d* has shaped holes 12, 14, 16 and 18 corresponding to the shape of the corresponding frame member (e.g., circular, square, polygonal and the like).

FIG. 1 farther shows side rail supports 20 which are positioned between the corner posts 10 *a* and 10 *b* and corner posts 10 *c* and 10*d* (in a length-wise direction). The side rail supports 20 each have opposing end holes 22*a* which, in the assembled arrangement, are fully positioned within the hollow center section of each corner post 10*a*, 10*b*, 10*c* and 10*d*. Thus, when the frame of the present invention is assembled, end portions of the side rail supports 20 extend into the holes 12 of the corner posts 10*a*, 10*b*, 10*c* and 10*d*. The opposing end holes 22*a* are substantially aligned with the longitudinal axis "Y" of each corner post 10*a*, 10*b*, 10*c* and 10*d*.

The side rail supports 20 also include additional holes 22*b* and 22*c* which accommodate vertical guide rail supports 35 and horizontal bed foundation supports 50, respectively. In the embodiment of FIG. 1, the horizontal bed foundation supports 50 extend in a width-wise direction between the side rail supports 20, and when assembled extend into the holes 22*b* of the side rail supports 22. This provides support and stability to the horizontal bed foundation supports 50. Similarly, the vertical guide rail supports 35 extend into the holes 22*c* and extend in an upward direction.

In the embodiment as shown in FIG. 1, the vertical guide rail supports 35 extend to upper horizontal side rails 30. Similar to the side rail supports 20, each upper horizontal side rail 30 extends in a length direction between opposing corner posts 10 *a* and 10*b* and corner posts 10*c* and 10*d*. The horizontal side rails 30 also include opposing end holes 32 which, in the assembled arrangement, are fully inserted into the hollow center section of each corner post 10*a*, 10*b*, 10*c* and 10*d*. Thus, when the frame of the present invention is assembled end portions of the horizontal side rails 30 extend into the holes 18 of the corner posts 10*a*, 10*b*, 10*c* and 10*d*. In the assembled construction, the opposing end holes 32 of the upper horizontal side rails 30 are substantially aligned with the longitudinal axis "Y" of each corner post 10*a*, 10*b*, 10*c* and 10*d* and the opposing end holes 22*a* of the side rail supports 20.

As further seen in FIG. 1, intermediate guard rails 30*a* extend through holes 35*a* of the vertical guide rail supports 35, and further extend between the corner posts 10*a* and 10*b* and corner posts 10*c* and 10*d*. In the preferred embodiment, the intermediate guard rails 30*a* do not extend fully into the hollow center section of each corner post 10*a*, 10*b*, 10*c* and 10*d*, but are inserted into the hollow center section so that they cannot be removed without disassembling the frame of the present invention. The intermediate guard rails 30*a* in combination with the upper horizontal side rails 30 form an integrated safety rail on the sides of the bed so that children or other users will not fall from the top bed.

Safety rails are also formed at the ends of the bed by rails 31. The rails 31 also provide further stability and stiffness to the framing system of the present invention. More specifically, the rails 31 extend between the corner posts 10*a* and 10*c* and corner posts 10*b* and 10*d*. The rails 31 each have opposing end holes 31*a* which are inserted into the holes 14 of each of the corner posts 10*a*, 10*b*, 10*c* and 10*d* (when assembled). In the assembled construction, the holes 31*a* are substantially aligned with (i) the longitudinal axis "Y" of each corner post 10 *a*, 10*b*, 10*c* and 10*d*, (ii) the opposing end holes 22*a* of the side rail supports 20 and (iii) the opposing end holes 32 of the upper horizontal side rails 30.

Still referring to FIG. 1, ladder rungs 40 extend between opposing corner posts 10 *a* and 10*c* and corner posts 10*b* and 10*d*. The ladder rungs 40 not only provide an integrated ladder system when the frame of the present invention is assembled, but additionally provide support and stability to the framing system. The ladder rungs 40 each include opposing end holes 42 which extend into the holes 14 of the corner posts 10*a*, 10*b*, 10*c* and 10*d*. In the assembled construction, the opposing end holes 42 of the ladder rungs 40 are substantially aligned with (i) the longitudinal axis "Y" of each corner post 10*a*, 10*b*, 10*c* and 10*d*, (ii) the opposing end holes 22*a* of the side rail supports 20, (iii) the opposing end holes 32 of the horizontal side rails 30 and (iv) the opposing end holes 31*a* of the rails 31. In order to properly assemble the bed frame of the present invention as seen more clearly in FIG. 2, the ladder rungs 40 and the rails 31*a* re at a different height than the (i) side rail supports 20, (ii) the horizontal side rails 30 and (iii) the intermediate guard rails 30*a*.

FIG. 1 also shows dowels 60 which extend through transverse openings and into the hollow center section of the corner posts 10*a*, 10*b*, 10*c* and 10*d* during the entire frame assembly process. Being more specific, in the assembled form, the dowels 60 (preferably with a tapered end portion) are inserted in the hollow center section of the corner posts 10*a*, 10*b*, 10*c* and 10*d* (via the transverse openings) and placed (tapered end portion first) through the opposing end holes of the (i) the side rail supports 20, (ii) the horizontal side rails 30, (iii) the ladder rungs 40 and (iv) the rails 31. The dowels 60 may include a tapered edge for easier insertion into the respective opposing end holes. In this manner, the ladder system and the safety rail system are interlocked to the entire framing system, and cannot be disassembled unless the dowels 60 are removed from each corner post 10*a*, 10*b*, 10*c* and 10*d*. It is thus apparent that welds, bolts and other fastening means are not needed to assemble the framing system of the present invention, including the ladder rungs and the safety rails.

Once assembled, end caps 70 may be positioned on the top of each corner post 10*a*, 10*b*, 10*c* and 10*d* to conceal the dowels 60. Also, vertical side bar supports 90 may be positioned between the lower side rail support 20 and the floor to provide added stability to the framing system of the present invention. For additional stability and stiffness, brackets 80 may also be provided between the corner posts and the support rails (or other appropriate position).

Figure 2:
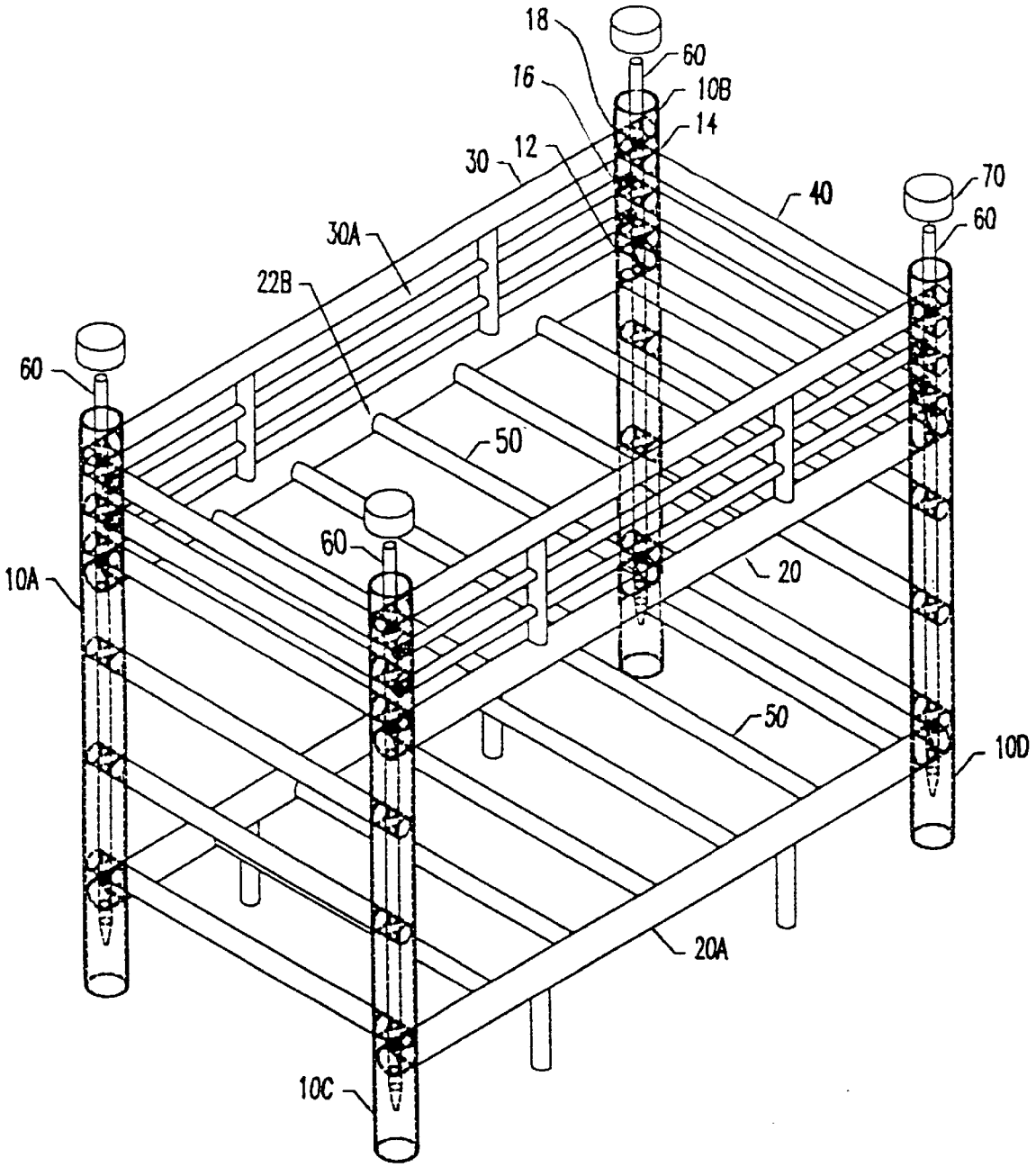
FIG. 2 is a perspective view of the bed in a partially assembled form according to the first embodiment of the present invention.

FIG. 2 is a perspective view of the bed in a partially assembled form according to the first embodiment of the present invention. More specifically, FIG. 2 shows all of the frame members respectively connected to one another (as discussed in detail with reference to FIG. 1), and the dowels 60 partially inserted within the hollow center section of each of the corner posts 10*a*, 10*b*, 10*c* and 10*d*. As seen clearly in FIG. 2, the respective opposing end holes of (i) the side rail supports 20, (ii) the horizontal side rails 30, (iii) the ladder rungs 40 and (iv) the rails 31*a* are each inserted into the respective holes 12, 14, 16 and 18 and extend into the hollow center section of each of the corner posts 10*a*, 10*b*, 10*c* and 10*d*. As also seen in FIG. 2, each of the opposing end holes are aligned with one another as well as with the longitudinal axis "Y" of the corner posts. This allows the dowels 60 to be inserted through each opposing end hole positioned within the center hollow section of the corner posts.

Once there is substantial alignment of all of the opposing end holes, the dowels 60 are fully inserted in the hollow center section of the corner posts 10*a*, 10*b*, 10*c* and 10*d* and placed through (via transverse openings of the corner posts) the respective opposing end holes of (i) the side rail supports 20, (ii) the horizontal side rails 30, (iii) the ladder rungs 40 and (iv) the rails 31. Also, the horizontal bed foundation supports 50 are preferably inserted into the holes 22*b* of the side rail supports 20 prior to the dowels 60 being inserted into the respective opposing end holes. In this manner, the entire frame is provided in an integrated unit of sturdy construction.

In the preferred method of assembly, the (i) side rail supports 20, (ii) horizontal side rails 30 and (iii) intermediate guard rails 30*a* are first inserted into the respective holes of the respective corner posts. Thereafter, the ladder rungs 40 and the rails 31*a* reinserted into the respective corner posts while also inserting the horizontal bed foundation supports 50 into the holes of the side rail supports 20. After the frame members are assembled, the dowels 60 are placed through the respective opposing end holes, as described above. In this manner, the frame of the present invention is constructed using an interlocking system which provides a sturdy and rugged construction.

It is important to note that the above described method of assembly is but one preferred method of assembly. For example, the above described method of assembly does not include the use of the vertical guide rail supports 35. In other assembly methods contemplated for use by the present invention, the vertical guide rail supports 35 may be used by placing the intermediate guard rails 30*a* through the holes 35*a* of the vertical guide rail supports 35 prior to inserting the intermediate guard rails 30*a* into the respective holes of the corner posts. The remaining assembly method as described above can then be performed.

Figure 3:
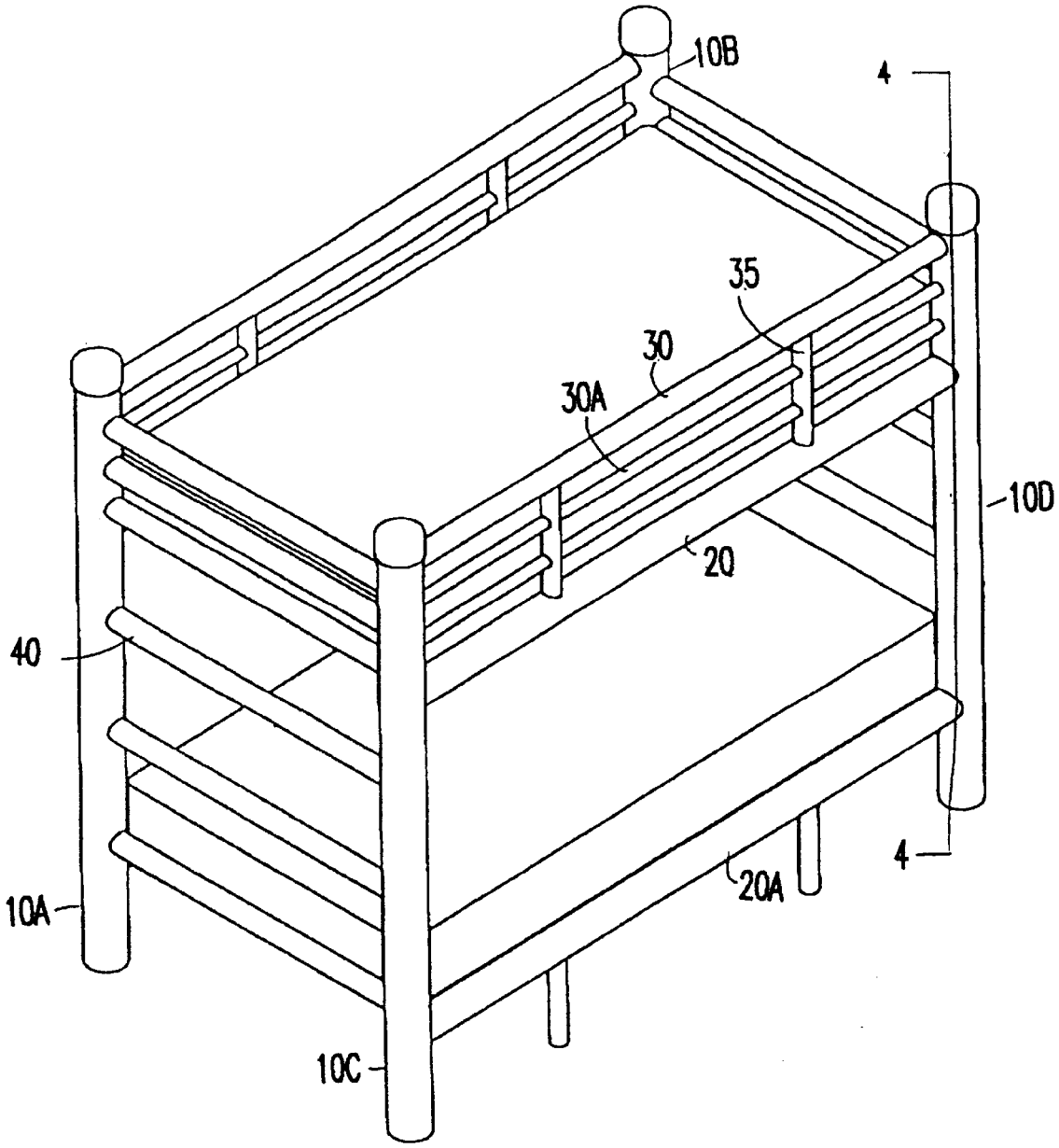
FIG. 3 is a perspective view of a fully assembled bed according to the first embodiment of the present invention.

FIG. 3 is a perspective view of a fully assembled bed according to the first embodiment of the present invention. In FIG. 3, the dowels 60 are completely inserted in the hollow center section of the corner posts, and the end caps 70 are placed at the ends thereof. The end caps 70 conceal the dowels 60 and further prevent the dowels 60 from exiting the hollow center section of the corner posts.

Figure 4:
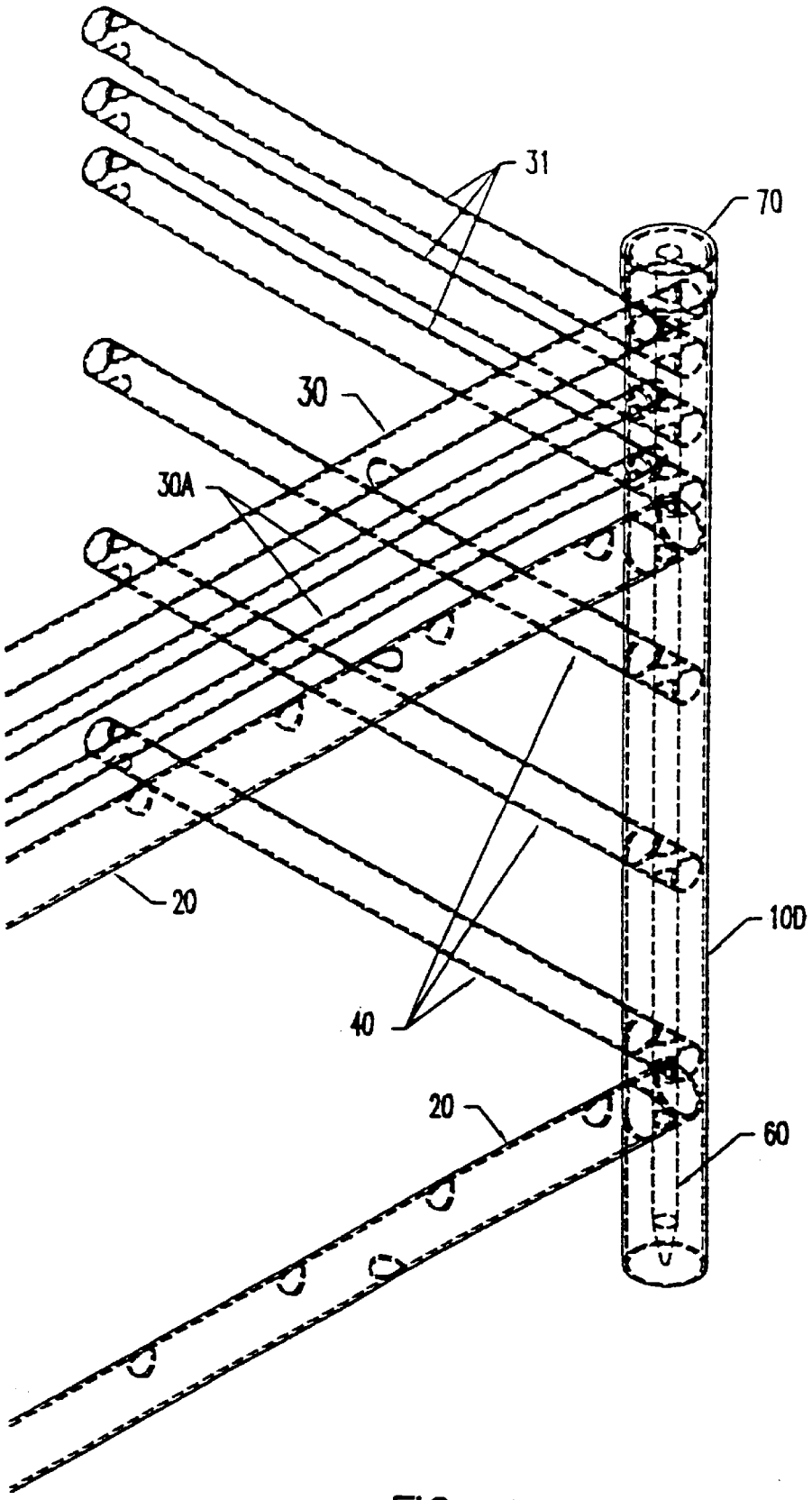
FIG. 4 is a partial cut away view along line 4—4 of FIG. 3.

FIG. 4 is a partial cut away view along line 4—4 of FIG. 3. In this view, the dowel 60 is clearly shown to extend within the hollow center section of corner post 10*d* and through the respective opposing end holes of the frame members, including the ladder rungs 40, the side rail supports 20 and the horizontal side rails 30. In this same manner, the dowel 60 will also extend in a similar manner within the hollow center section of corner post 10*a*, 10*b* and 10*c* and through the other respective opposing end holes of the frame members.

Figure 5:
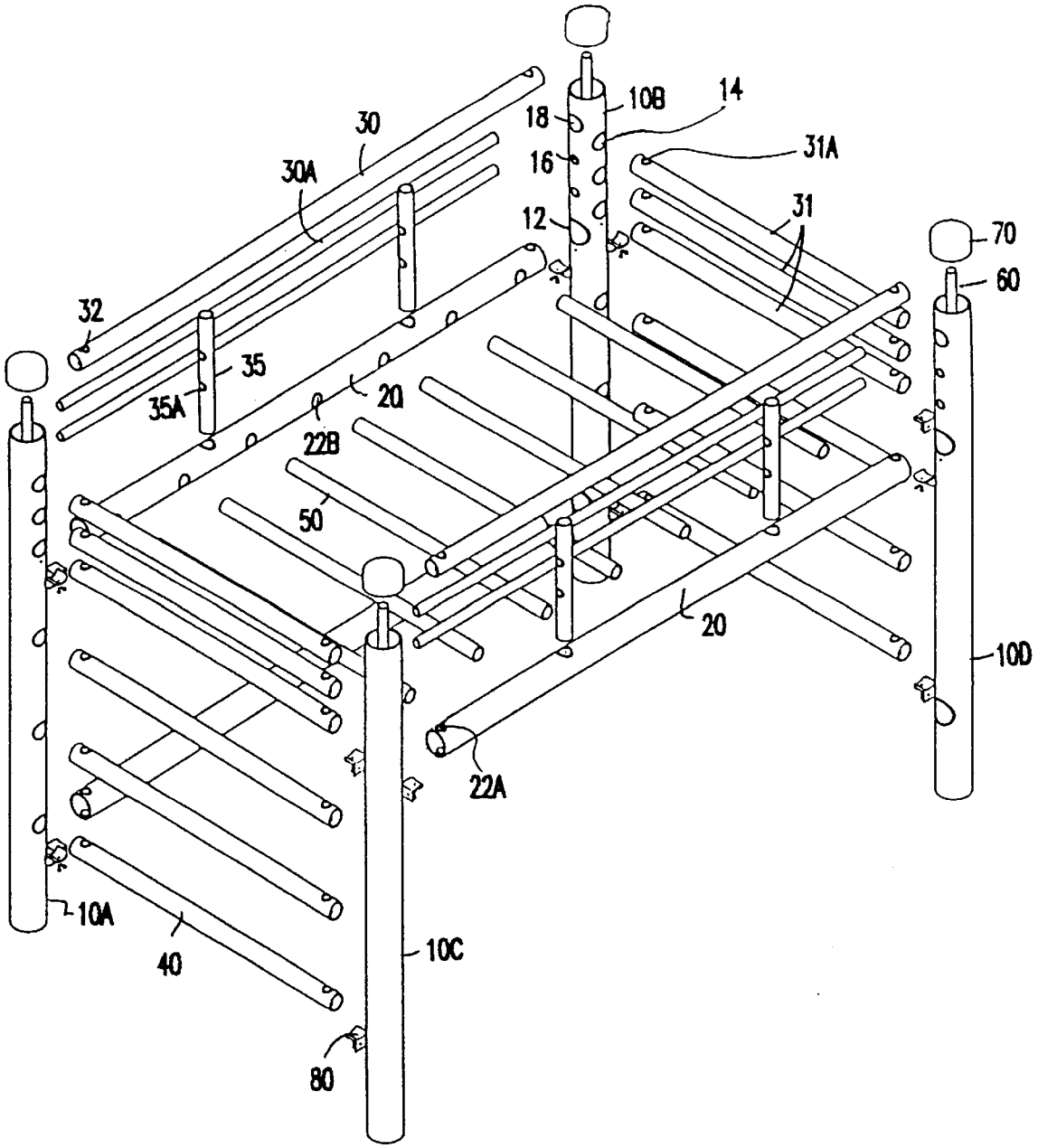
FIG. 5 is a perspective view of a bed in an unassembled form according to a second embodiment of the present invention.

FIG. 5 is a perspective view of a bed in an unassembled form according to a second embodiment of the present invention. The second embodiment of FIG. 5 is directed to a high rise or loft bed and includes substantially all of the same frame members of the embodiment of FIG. 1 (except for the lower side support rail 20*a*). Accordingly, the same reference numerals are used for like elements.

Similar to the assembled embodiment of FIG. 1, the high rise bed of FIG. 5 includes the dowels 60 inserted within the hollow center section of the corner posts 10*a*, 10*b*, 10*c* and 10*d* and placed through the respective opposing end holes of the (i) the side rail supports 20, (ii) the horizontal side rails 30, (iii) the ladder rungs 40 and (iv) the rails 31. The embodiment of FIG. 5 also includes the vertical guide rail supports 35 and horizontal bed foundation supports 50, and may also include the brackets 80. However, the embodiment of FIG. 5 does not include vertical side bar supports 90, nor does the embodiment of FIG. 5 include the lower side rail support 20*a* of the lower foundation supports 50. The side rail supports 20 may be provided at the rear end of the bed.

It should be well understood by one of ordinary skill in the art that the high rise frame of FIG. 5 is assembled in substantially the same manner as provided with reference to the embodiment of FIG. 1. The embodiment of FIG. 5 also provides the same advantages as the embodiment of FIG. 1. These advantages include, for example, an interlocking assembly system for sturdy construction, an integrated ladder system and safety rail system as well as a frame system that provides different diameter tubing for easy and compact packaging, shipping and handling. It should further be understood that traditional single, twin, extra long twin, full, double, queen and king beds can be assembled in substantially the same manner. These constructions may or may not include the safety rails and ladder features; however, the compact storage, connectorless construction with rigid mattress support attributes can be realized in these configurations.

Figure 6:
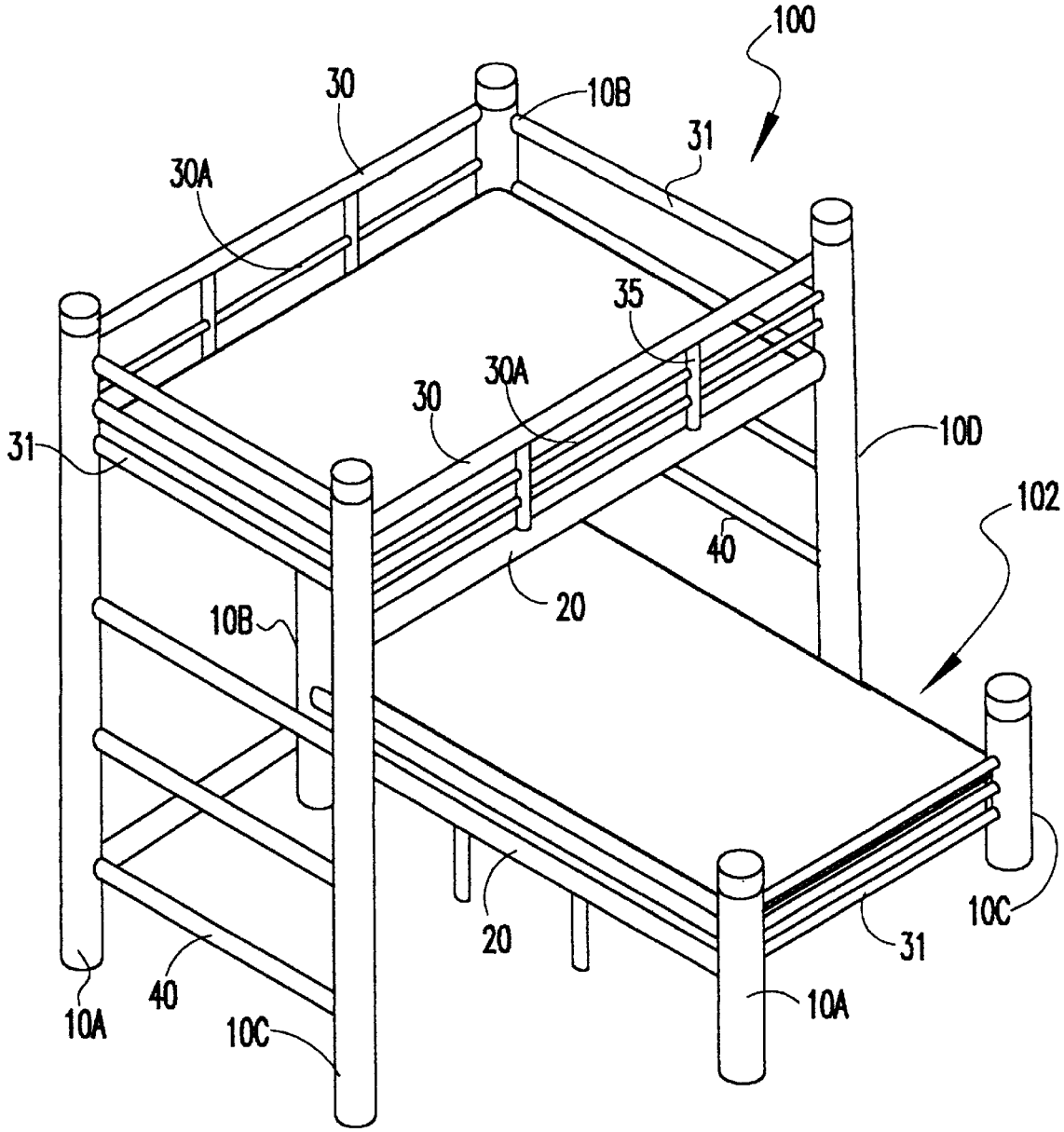
FIG. 6 is a perspective view of assembled beds according to the second embodiment of the present invention.

FIG. 6 is a perspective view of a loft bed and a non-loft bed according to the embodiment of FIG. 5. As seen in the embodiment of FIG. 5, the framing system of the loft bed 100 is substantially identical to the embodiment of FIG. 1 except for the vertical side bar supports 90 and the lower side rail support 20*a* and lower foundation supports 50. FIG. 6 further shows a non-loft bed 102 which is capable of being placed below the loft bed 100. The non-lofted bed 102 is constructed in the substantially same manner as the loft bed of FIG. 5, except ladder rungs are not necessary for this construction. Also, side support rails and guard rails are not required, but are nonetheless contemplated for use with the non-lofted bed 102 present invention.

Figure 7:
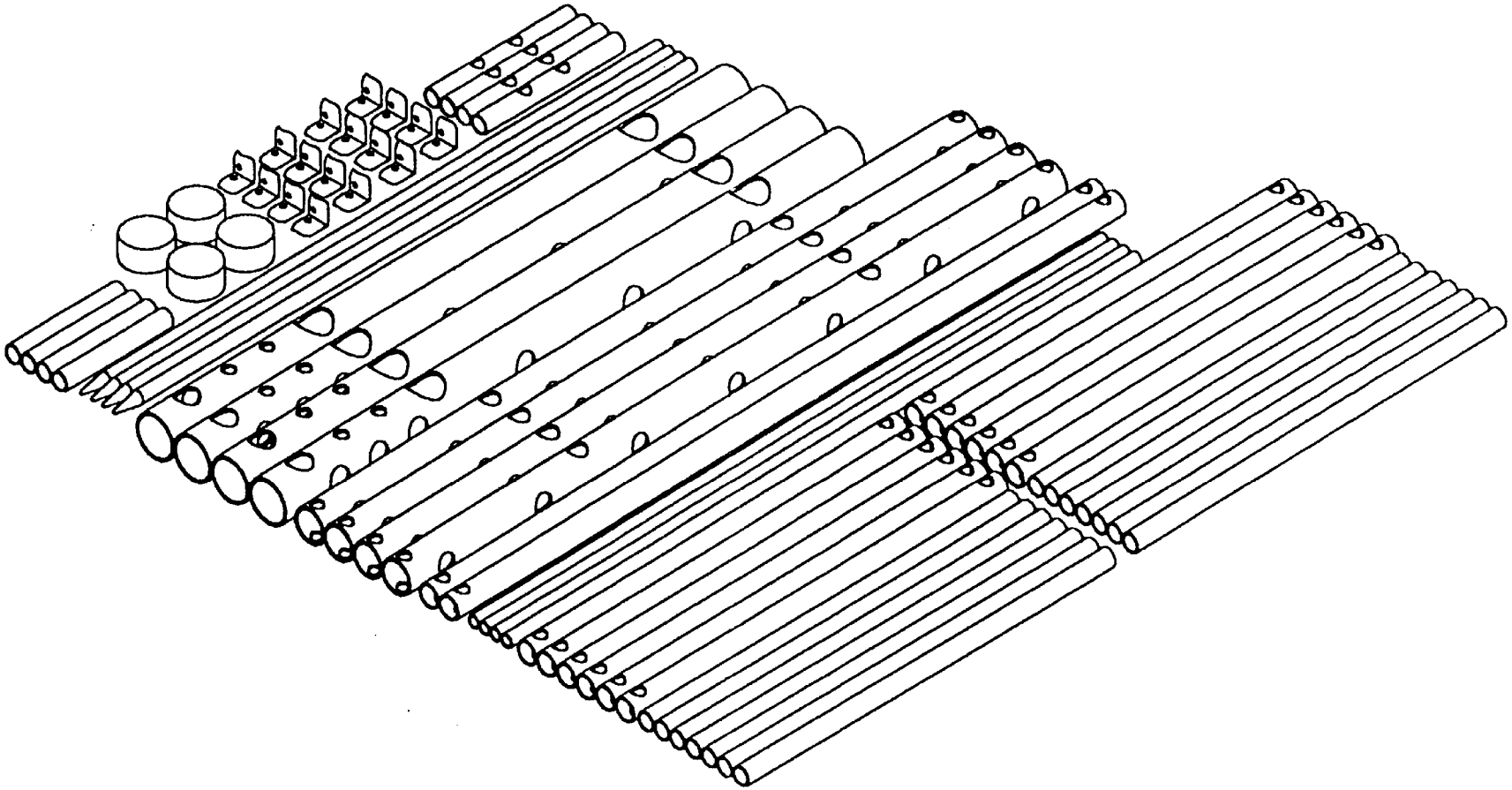
FIG. 7 shows all of the components of the bed of the first embodiment of FIG. 1 prior to being packaged.

FIG. 7 shows the components of the bed according to the first embodiment prior to being packaged into a box or other shipping means such as a bag. FIG. 7 may equally represent components of a bed according to the second embodiment. In FIG. 7, the smaller diameter frame members (e.g., horizontal bed foundation supports 50) fit within or are concentrically disposed within the larger diameter frame members (e.g., side rail support 20). The dowels are placed within the smaller diameter frame members. It is noted that even smaller frame members may be fit with or may be concentrically disposed within the smaller diameter frame members. In this manner, the frame members may be compactly packaged together. This packaging will work equally well with frame members of other cross sections such as, for example, square, triangular, polygonal and the like.

Figure 8:
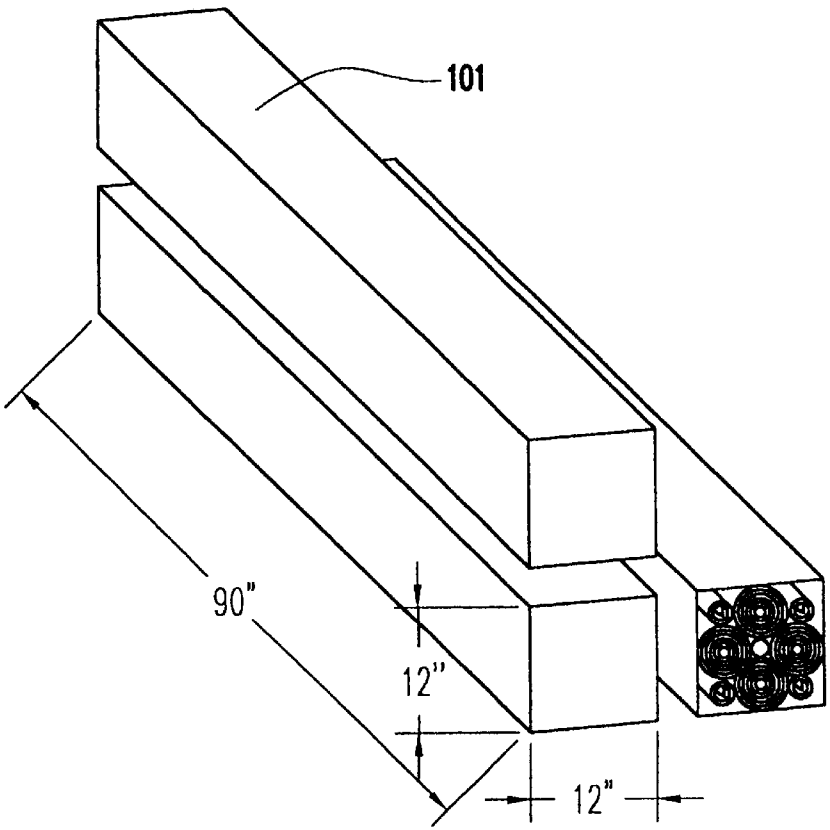
FIG. 8 shows the packaged bed frames of both the embodiments of FIG. 1 and FIG. 5.

FIG. 8 shows the frame members of both the first and second embodiments of the present invention packaged in several boxes 101. The boxes are preferably 90 inches long, 12 inches wide and 12 inches in height. It is noted, of course, that other box sizes and shapes are contemplated for use with the present invention depending on the specific dimensions of the frame members. The entire framing system of either embodiment may also fit within one of the boxes as described above, but such a packaging configuration will be heavier in weight. In any case, in order to place the frame members within the boxes 101, it is first necessary to insert the smaller diameter frame members into the larger diameter frame members and the dowels 60 within the smaller diameter frame members in accordance with the discussion of FIG. 7. This will allow the frame members to be more compactly packaged. Once the frame members are properly inserted into one another, they can then be placed within the boxes 101 for shipping and the like. Alternatively, the larger diameter frame member may be placed within the box first, and thereafter the smaller diameter frame members placed within the larger diameter frame members within the box.

By using the framing system of the present invention, it is readily understood that the ladder system and the safety rail system are integral parts of the frame system of the present invention. There is thus no need to use bolts, welds or other fasteners which may fail over an extended use. These integral ladder and rail systems provide added safety to the user as well as provide further stability to the frame system of the present invention. For example, the integrated ladder system of the present invention will not slip away from the frame and will not fail after extended use. This latter point is due to the fact that there are no welds or other fasteners that may fail. Also, by using the construction of the present invention, sharp edges, weld failures and other shortcomings of the prior art systems are avoided. It is further noted that the present invention is easy to assemble and disassemble, and due to the interlocking system may be disassembled and reassembled numerous times without any concern to the overall integrity of the system.

While the invention has been described in terms of the preferred embodiments, those skilled in the art will recognize that the invention can be practiced with modification within the spirit and scope of the appended claims.

What is claimed is:

1. An interlocking framing system, comprising:

corner posts having a hollow center section and a plurality of holes along a length thereof;

side support members having opposing ends and opposing end holes and a plurality of support holes along a length thereof, said opposing ends being positionable through said plurality of holes of said corner posts such said opposing end holes are aligned with a longitudinal axis of said corner posts;

a plurality of bed foundation support rails positionable between said side support members, each of said bed foundation support rails having opposing ends which extend into one of said plurality of support holes of said side support members, said plurality of bed foundation support rails adapted to support a mattress or bedding; and dowels which extend into said hollow center section of said corner posts, each of said dowels being placed through said opposing end holes of said side support members along the longitudinal axis of said corner posts, wherein said plurality of bed foundation support rails are locked within said plurality of support holes of said side support members when said dowels extend into said hollow section and are placed through said opposing end holes of said side support members.

2. The interlocking framing system of claim 1, further comprising:

ladder rungs having opposing end holes, said ladder rungs being positionable through another set of said plurality of holes of said corner posts and extending into said hollow center section of said corner posts, wherein said dowels are placed through said opposing end holes of said ladder rungs, and wherein said ladder rungs are locked within said corner posts when said dowels extend into said hollow section of said corner posts and are placed through said opposing holes of said side ladder rungs.

3. The interlocking framing system of claim 1, wherein said corner posts, said side support members and said plurality of bed foundation support rails each have a cross sectional shape of circular, square, triangular or polygonal.

4. The interlocking framing system of claim 1, further comprising a safety rail system connecting between said corner posts.

5. The interlocking framing system of claim 1, wherein the framing system is adapted for a bunk bed or a high rise bed.

6. An interlocking framing system, comprising:

corner posts having a hollow center section and a plurality of holes along a length thereof;

side support members having opposing ends and opposing end holes, said opposing ends being positioned through a first set of said plurality of holes of said corner posts;

ladder rungs having opposing ends and opposing end holes, said ladder rungs being positionable through a second set of said plurality of holes of said corner posts; and dowels extending into said hollow center section of said corner posts, each of said dowels being placed through said opposing end holes of said ladder rungs and said side support members, wherein said ladder rungs are locked within to said corner posts when said dowels extend into said hollow section and are placed through said opposing end holes of said ladder rungs.

7. The interlocking framing system of claim 6, further comprising safety rails positionable between said corner posts.

8. The interlocking framing system of claim 7, wherein said safety rails include opposing end holes which are locked to said corner posts by said dowels.

9. The interlocking framing system of claim 6, wherein said side support members have a plurality of support holes along a length thereof and further comprising, a plurality of foundation support rails each of which include ends positionable within said plurality of support holes of said side support members.

10. The interlocking framing system of claim 6, wherein said opposing end holes of said side support members are aligned with a longitudinal axis of said corner posts.

11. An interlocking framing system, comprising:

corner posts having a hollow center section and a plurality of holes along a length thereof;

side support members having opposing ends and opposing end holes, said opposing ends being positionable through a first set of said plurality of holes of said corner posts in a first direction;

safety rails positionable between said corner posts in the first direction, wherein selected safety rails have opposing ends and opposing end holes, said opposing ends being positionable through a second set of said plurality of holes of said corner posts;

dowels extending into said hollow center section of said corner posts, each of said dowels being placeable through said opposing end holes of said safety rails and said side support members, wherein said safety rails are locked to said corner posts when said dowels extend into said hollow section and are placed through said opposing end holes of said selected safety rails; and other selected safety rails extend into a third set of said plurality of holes of said corner posts, said other selected safety rails not interfering with said dowels when said dowels extend into said hollow section and are placed through said opposing end holes of said selected safety rails.

12. The interlocking framing system of claim 11, further comprising ladder rungs locked to said corner posts by said dowels when each of said dowels are placed through said opposing end holes of said safety rails and said side support members.

13. The interlocking framing system of claim 11, wherein other selected safety rails extend into a third set of said plurality of holes of said corner posts, said other selected safety rails not interfering with said dowels when said dowels extend into said hollow section and are placed through said opposing end holes of said selected safety rails.

14. A knock down framing system, comprising:

corner posts having a hollow center section and a first size;

side support members having a hollow center section and a second size, said side support members fitting into the hollow section of said corner posts; and a plurality of dowels, said plurality of dowels fitting into the hollow section of one of said corner posts and said side support member, wherein, in a knock down state, the dowels are adapted to slidably fit into the hollow center section of the side support members and the side support members are adapted to slidably fit into the hollow section of the corner posts.

15. The knock down framing system of claim 14, further comprising foundation support rails having a hollow center section and a third size, said foundation support rails fitting into the hollow section of one of said corner posts and said side support members.

16. The knock down framing system of claim 14, wherein said corner posts, said side support members and said plurality of bed foundation support rails each have a cross sectional shape of circular, square, triangular or polygonal.

* * * * *